US005464507A

United States Patent [19]

de Nora et al.

[11] Patent Number: 5,464,507

[45] Date of Patent: Nov. 7, 1995

[54] PROCESS FOR THE ELECTROLYTIC DEPOSITION OF METALS

[75] Inventors: Oronzio de Nora; Antonio Nidola; Ulderico Nevosi; Carlo Traini, all of Milan, Italy

[73] Assignee: De Nora Permelec S.p.A., Italy

[21] Appl. No.: 296,090

[22] Filed: Aug. 25, 1994

Related U.S. Application Data

[60] Continuation of Ser. No. 25,969, Mar. 3, 1993, abandoned, which is a division of Ser. No. 839,114, Feb. 20, 1992, abandoned.

[30] Foreign Application Priority Data

| | | | |
|---|---|---|---|
| Feb. 26, 1991 | [IT] | Italy | 91000479 |
| Feb. 28, 1991 | [IT] | Italy | 91000514 |
| Mar. 1, 1991 | [IT] | Italy | 91000550 |

[51] Int. Cl.[6] ..... C25C 1/22; C25C 1/14; C25C 1/18

[52] U.S. Cl. ..... 204/105 R; 204/114; 204/120

[58] Field of Search ..... 205/299, 300; 204/291, 114, 120, 290 R, 105 R

[56] References Cited

U.S. PATENT DOCUMENTS

| | | | |
|---|---|---|---|
| 3,772,168 | 11/1973 | Dillenberg | 204/435 |
| 4,146,438 | 3/1979 | De Nora et al. | 204/67 |
| 4,720,334 | 1/1988 | DuBois et al. | 204/296 |
| 5,207,877 | 5/1993 | Weinberg et al. | 204/130 |

OTHER PUBLICATIONS

Hibbert et al., Dictionary of Electrochemistry, "Electroplating", Second Edition, p. 127, 1984.

*Primary Examiner*—Kathryn Gorgos
*Attorney, Agent, or Firm*—Bierman and Muserlian

[57] ABSTRACT

A process for the electrolytic recovery of metals from solutions containing metal ions and fluorides and/or anionic flurocomplexes in diaphragmless cells wherein the deposition of the metals at the cathodes and the oxygen evolution at the anodes is effected, the improvement comprising the use of insoluble anodes made of sintered powders of doped tin dioxide optionally provided with coating of zirconyl phosphate and metal oxides which prevents the deposition of metal oxides on the anode surface and catalyze the oxygen evolution reaction.

9 Claims, No Drawings

PROCESS FOR THE ELECTROLYTIC DEPOSITION OF METALS

DESCRIPTION OF THE INVENTION

This is continuation of Ser. No. 08/025,969, filed Mar. 3, 1993, now abandoned, which is divisional of Ser. No. 07/839,114, filed Feb. 20, 1992, now abandoned.

STATE OF THE ART

Electrolytes containing anionic fluorocomplexes are commonly used in conventional technologies for the electrolytic recovery of metals, such as lead, tin, chromium. In the specific case of lead recovery from batteries scraps, the scraps ape leached with acid solutions containing tetrafluoroborates $BF_4^-$ and hexafluorosilicates $SiF_6^=$. The electrolysis of these solutions produces lead as a solid deposit; therefore, the electrolytic cells ape diaphragmless and have a very simple design. However, this advantage has been so far counterbalanced by the scarce resistance of the substrates to the aggressive action of anionic fluorocomplexes on the anodes whereat oxygen is evolved. Further a parasitic reaction may take place with formation of lead dioxide which subtracts lead to the galvanic deposition of the metal, thus reducing the overall efficiency of the system Upon carefully considering the prior art teachings found for example in U.S. Pat. Nos. 3,985,630, 4,135,997, 4,230,545, 4,272,340, 4,460,442, 4,834,851 and in Italian patent application No. 67723 A/82, it may be concluded that:

- anodes made of carbon or graphite, as such or coated by lead dioxide, are known in the art but offer a rather limited active lifetime, in tile range of a hundred hours due to the oxidizing action of oxygen evolution. Obviously, this brings forth higher maintenance costs for substituting the anodes and additional costs connected to the consequent production losses;
- anodes made of titanium, coated by lead dioxide or platinum or oxides of the platinum group metals, still undergo corrosion, though to a far less extent with respect to carbon or graphite; in any case, insufficient for counterbalancing the higher construction costs;
- anodes made of tantalum coated by platinum metal or metal oxides offer a much longer lifetime than titanium, but the production costs are extremely high;
- the parasitic reaction of lead dioxide deposition onto any type of anode may be prevented by adding a suitable inhibitor to the leaching solution, for example phosphoric acid, antimony acid or arsenic acid. However, the quantities required may spoil the compactness of tire lead metal deposit. This problem is overcome by resorting to an anode having a coating made of metals or oxides of the platinum group metals and at least one element comprised in the group of arsenic, antimony, bismuth, tin. In this case, a remarkably lower quantity of inhibitor to prevent the anodic deposition of lead dioxide is required, and the deterioration of the produced lead deposit is eliminated.

It is therefore, evident than the prior art does not provide for an anode offering both a long lifetime (higher than 1000 hours) and a limited cost, which are both necessary features for a wide industrial application.

THE INVENTION

It has been surprisingly found that ceramic anodes made of sinterized powders of tin dioxide doped by suitable additives both to facilitate sinterization and to their electrical conductivity show an exceptional resistance to the aggressive action of acid solutions containing anionic fluorocomplexes, even under the severe conditions of oxygen evolution at high current densities 2000 A/m$^2$).

It has been further found that said ceramic anodes can be obtained by production techniques which are more simple and less expensive than those conventionally used to obtain ceramic products (isostatic pressing at 1200–2000 kg/cm$^2$ and sinterization at 1350°–1450° C. for 50–200 hours indicatively), irrespective of their functional characteristics, in particular of electrical conductivity.

Furthermore, it has been found that the oxygen evolution voltage of said anodes is considerably decreased, with the consequent advantageous decrease of the energy consumption, if the solutions containing metal ions and fluorides and/or anionic fluorocomplexes are added with suitable compounds. The same result is alternatively obtained by applying onto said anodes suitable coatings resistant to corrosion and provided with electrocatalytic activity or oxygen evolution.

Eventually, it has been found that the parasitic reaction of deposition of oxides of high valence metal ions on said anodes is efficaciously controlled by adding suitable inhibitors to the solutions containing the metal ions, fluorides and/or anionic fluorocomplexes.

The attempt to find an alternative technique to the conventional industrial production technique has been pursued with the aim to obtain, in large quantities and at low costs, products with a more complex geometry than the simple cylinder or tile so far available on the market, as for example tubes or hollow prism structures, as required for the anodes of the present invention. The technology illustrated in the following description permits to attain the aforesaid objects and eliminates the isostatic pressing step. It is characterized in that it comprises:

- precalcining the tin dioxide powder
- mixing the precalcined powder with powders of suitable additives to promote sinterization and improve electrical conductivity
- wet casting in molds, fop example in alabaster moulds
- drying in forced air
- sinterization at remarkably lower temperatures than the destabilization point of tin dioxide (1600° C.) but at the same time within extremely reduced times (4–10 hours)

The products thus obtained are substantially free from mechanical defects which would be dangerous for the structural integrity and are characterized by a density above 6 g/cm$^3$, a porosity below 9% and an electrical resistivity below 0.15 ohm.cm at ambient temperature. When these products are used as anodes in acid solutions containing anionic fluorocomplexes, the resistance to the aggressive action of the electrolyte under oxygen evolution at 1000–2000 A/m2 is absolutely satisfactory. At said conditions, the voltage of oxygen evolution is in the range of 2.7–2.8 Volts (NHE), where (NHE) means that a Normal Hydrogen Electrode is taken as a reference for the voltage values. The above mentioned values involve a high energy consumption (kWh/ton of produced metal) which may be considerably reduced, for example to 2.1–2.2 Volts (NHE), by adding to the electrolytic solutions, containing fluorides and/or anionic fluorocomplexes, suitable elements for catalyzing the oxygen evolution reaction by a homogeneous catalytic mechanism. Suitable additives are those capable of releasing into the solutions the ionic couples $Ce^{III}/Ce^{IV}$ and $Pr^{III}/Pr^{IV}$. A cyclic reaction probably takes place as follows:

$$2Ce^{III}-2e^- \rightarrow 2Ce^{IV}$$

$$2Ce^{IV}+H_2O \rightarrow 2Ce^{III}+\tfrac{1}{2}\,O_2+2H^{30}$$

$$2\,Ce^{III}-2e^{-} \rightarrow 2Ce^{IV}$$

An alternative procedure to obtain the same result, particularly advantageous when, for process reasons, the solution cannot be added with compounds of cerium and/or praseodimium, consists in applying to the ceramic anode, made of doped tin dioxide, an electrocatalytic coating directed to favoring oxygen evolution. This coating does not comprise metal of the platinum group or compounds thereof but is made of oxides of transition elements such as the lanthanides, for example cerium or praseodimium, added with other elements to increase their resistance to corrosion and the electrical conductivity, for example niobium, nickel, copper and manganese. Alternatively, this coating may be made of manganese dioxide, doped by copper and chromium.

In regards the deposition onto the anode surface of oxides of high valence metal ions, such as $Pb_2$, $SnO_2$ formed by oxidation of the metal ions present in the electrolytic solutions $Pb^{++}$, $Sn^{++}$, it must be pointed out that this side-reaction should be hindered as much as possible. In fact, the formation of oxides decreases the cathodic efficiency of metal deposition and, in the long run, brings to the formation of muds which make the regular operation of the electrolysis cell difficult. Technical literature describes the use of additives, such as phosphoric acid, antimonic acid, arsenic acid, which, once added to the solutions, inhibit formation of metal oxides. In order to obtain the best efficiency when used the anodes of the present invention, these additives must be present in suitable concentrations not to spoil the quality of the metal deposited onto the cathode causing embrittlement and pulverization of the same. It has been found that zirconyl phosphate completely inhibits these negative by-side reactions. In fact its compound bars formation of metal oxides at the anode even when present in minimum concentrations. Further, it has been surprisingly found zirconyl phosphate may be applied as an external layer onto the anodes of the invention already provided with an electrocatalytic coating. This external layer can inhibit formation of high valence metal oxides so that the addition of zirconyl phosphate to the solution may be reduced to extremely low levels, thus increasing the quality of the metal obtained at the cathode.

These and other features of the present invention are illustrated in the following Examples which, however, should not be intended as a limitation of the present invention.

EXAMPLE 1

Eleven rods, having a diameter of 10 mm and a length of 100 mm, have been prepared according to the following procedure:

- precalcination of tin dioxide powder (800°–1200° C. for eight hours, average final size of the particles: 1–20 microns)
- mechanical mixing, in a ball mill, of the tin dioxide powder and additives necessary to favor sinterization, in alternative to CuO, conventionally used in the prior art;
- dispersion of the powders in an aqueous medium with the addition of nitrogen bearing surfactants;
- casting in an alabaster mold
- natural drying followed by drying at 60°–120° in forced air sinterization at 1250° C. in a gas-fired oven for 8 hours The density (grams/cubic centimeter) and the electrical resistivity (ohm/centimeter) have been detected on the above samples and the relevant data are reported on Table 1,

TABLE 1

| Sample No. | Additive Type | Ratio % by weight | Density g/cc | Resistivity ohm · cm 20° C. | 1000° C. |
|---|---|---|---|---|---|
| 1 | — | — | — | — | — |
| 2 | CuO | 1.0 | 6.49 | $10^5$ | 1.5 |
| 3 | $Nb_2O_5$ | 0.5 | 6.05 | $10^6$ | 5 |
| 4 | " | 1.0 | 6.07 | $10^6$ | 5 |
| 5 | " | 5.0 | 5.97 | $10^6$ | 5 |
| 6 | $Ta_2O_5$ | 0.5 | 6.15 | $10^6$ | 3.7 |
| 7 | " | 1.0 | 6.21 | $10^6$ | 3.7 |
| 8 | " | 5.0 | 6.26 | $10^6$ | 5 |
| 9 | NiO | 0.5 | 6.12 | $10^6$ | 4 |
| 10 | " | 1.0 | 6.15 | $10^5$ | 3.7 |
| 11 | " | 5.0 | 6.17 | $10^5$ | 6.2 |
| 12 | ZnO | 0.5 | 6.03 | $>10^6$ | >5 |
| 13 | " | 1.0 | 6.02 | $>10^6$ | >5 |
| 14 | " | 5.0 | 5.97 | $>10^6$ | 5 |
| 15 | CuO + $Nb_2O_5$ | 1.0 + 0.5 | 6.49 | $10^5$ | 3.1 |
| 16 | CuO + $Ta_2O_5$ | 1.0 + 0.5 | 6.48 | $10^5$ | 3 |
| 17 | CuO + NiO | 1.0 + 0.5 | 6.54 | $10^5$ | 3 |
| 18 | CuO + ZnO | 1.0 + 0.5 | 6.41 | $10^5$ | 3.7 |

The results reported in Table 1 lead to the following conclusions:

- all the additives exhibit a sinterizing action;
- the additives used in admixtures are characterized by a greater efficiency with respect to the same additives used alone (synergism);
- when the additives are used alone, at the same concentration and sinterization conditions (temperature and time), the efficiency increases according to the following order:

$$ZnO<Nb_2O_5<NiO<Ta_2O_5<CuO;$$

- when the additives are used in admixtures and at the same sinterization conditions, the efficiency increases according to the following order:

$$CuO+ZnO<CuO+Nb_2O_5<CuO+Ta_2O_5<CuO+NiO.$$

The same results have been obtained with tubes having an internal diameter and an external diameter respectively of 22 and 30 mm and a length of 120 nun produced by continuous extrusion. Apart from the extrusion procedure, the other production steps remained unvaried with respect to the above described wet casting procedure, in particular in regard to temperatures and times.

EXAMPLE 2

Thirty eight tubes having internal and external diameter of 22 and 30 mm respectively, and a length of 120 mm have been prepared according to the extrusion and sinterization procedure illustrated in Example 1, utilizing composition no. 2 of Example 1, containing further additives to decrease the electrical resistivity. The density and electrical resistivity have been detected on the tubes thus obtained and the results are reported in Table 2.

TABLE 2

| Sample No. | Additive Type | Content % by weight | Density g/cc | Resistivity ohm · cm 20° C. | 1000° C. |
|---|---|---|---|---|---|
| 1 | — | — | — | — | — |
| 2 | $Sb_2O_3$ | 1.0 | 6.50 | 0.15 | 0.005 |
| 3 | " | 2.0 | 6.49 | 0.15 | 0.007 |
| 4 | " | 2.5 | 6.49 | 0.2 | 0.005 |
| 5 | " | 3.0 | 6.49 | 0.18 | 0.009 |
| 6 | $Bi_2O_3$ | 0.5 | 6.48 | 0.3 | 0.045 |
| 7 | " | 1.0 | 6.48 | 0.3 | 0.025 |
| 8 | " | 1.5 | 6.49 | 0.3 | 0.025 |
| 9 | " | 2.0 | 6.47 | 0.35 | 0.027 |
| 10 | $Al_2O_3$ | 0.3 | 6.47 | 0.42 | 0.03 |
| 11 | " | 1.0 | 6.47 | 0.5 | 0.03 |
| 12 | " | 1.5 | 6.46 | 0.4 | 0.03 |
| 13 | " | 2.0 | 6.45 | 0.47 | 0.03 |
| 14 | $Fe_2O_3$ | 0.5 | 6.48 | 0.28 | 0.02 |
| 15 | " | 1.0 | 6.48 | 0.3 | 0.007 |
| 16 | " | 1.5 | 6.48 | 0.3 | 0.007 |
| 17 | " | 2.0 | 5.40 | 0.3 | 0.007 |
| 18 | " | 3.0 | 6.45 | 0.5 | 0.007 |
| 19 | " | 5.0 | 6.45 | 0.7 | 0.02 |
| 20 | $Cr_2O_3$ | 0.5 | 6.5 | 0.15 | 0.02 |
| 21 | " | 1.0 | 6.5 | 0.15 | 0.007 |
| 22 | " | 1.5 | 6.5 | 0.15 | 0.005 |
| 23 | " | 2.0 | 6.5 | 0.15 | 0.015 |
| 24 | " | 3.0 | 6.47 | 0.2 | 0.007 |
| 25 | " | 5.0 | 6.48 | 0.38 | 0.028 |
| 26 | $Pr_6O_{11}$ | 0.5 | 6.48 | 0.15 | 0.009 |
| 27 | " | 1.0 | 6.5 | 0.18 | 0.007 |
| 28 | " | 1.5 | 6.5 | 0.15 | 0.007 |
| 29 | " | 2.0 | 6.48 | 0.19 | 0.09 |
| 30 | $La_2O_3$ | 0.5 | 6.48 | 1 | 1.5 |
| 31 | " | 1.0 | 6.5 | 1 | 1.2 |
| 32 | " | 5.0 | 6.47 | 2 | 1.2 |
| 33 | $Sb_2O_3 + Bi_2O_3$ | 2.5 + 1.0 | 6.48 | 0.18 | 0.007 |
| 34 | $Sb_2O_3 + Al_2O_3$ | 2.5 + 1.0 | 6.53 | 0.23 | 0.007 |
| 35 | $Sb_2O_3 + Fe_2O_3$ | 2.5 + 1.0 | 6.49 | 0.15 | 0.007 |
| 36 | $Sb_2O_3 + Cr_2O_3$ | 2.5 + 1.0 | 6.49 | 0.19 | 0.007 |
| 37 | $Sb_2O_3 + Pr_6O_{11}$ | 2.5 + 1.0 | 6.48 | 0.16 | 0.01 |
| 38 | $Sb_2O_3 + La_2O_3$ | 2.5 + 1.0 | 6.48 | 0.23 | 0.9 |

The results reported in Table 2 lead to the following remarks:

all the additives promote electrical conductivity at low temperatures;

for each additive a threshold concentration has been defined beyond which the promoting action no more increases or even decreases;

when the additives are used alone, the promoting action increases according to the following order:

$$La2O_3<Al_2O_3<Cr_2O_3<Fe_2O_3<Bi_2O_3<Pr_6O_{11}<Sb_2O_3$$

if used in admixtures (binary system), the promoting action is higher than that of the components used alone;

in particular, the promoting action of the couples of additives increases according to the following order:

$$Sb_2O_3+La2O_3<Sb_2O_3+Al_2O_3<Sb_2O_3+Cr_2O_3<Sb_2O_3+Bi_2O_3<Sb_2O_3+Pr_6O_{11}<Sb_2O_3+Fe_2O_3$$

Further tests directed to decrease the electrical resistivity by keeping the composition unchanged and by modifying the sinterization temperature indicated that the temperature must be maintained in the range of 1250°–1350° C., preferably 1300°–1350° C.

Further tests on the efficiency of other additives, in addition to those described in this Example, slowed that silver as a metal or oxide and oxides of cerium, neodimium, titanium give positive results. it may be concluded that low electrical resistivities may be obtained by adding oxides (or even metals in some cases) of elements of groups VA, IA, IIIA, IIIB, IVB, VB, VIII of the Periodic Table.

EXAMPLE 3

Emispheric caps, having a diameter of 30 mm have been produced by wet casting The composition was the same as that of the tube no. 4 of Example 2. The caps have then be welded to tubes, having internal and external diameter of 22 and 30 mm respectively, a length of 120 mm and a composition as given in Example 2, sample No. 4 using a ceramic enamel having a low melting point comprising tin dioxide added with lead oxide (0.5–5%), antimony, copper and cerium (for a total of 5 to 10%). The tube-cap assemblies have been sinterized at 1250° C. and a current feeder has then been applied thereto, according to the following procedure:

pretreatment of the internal surface of the tubes by corindone blasting and ultrasound cleaning introduction inside the tubes of a copper rod having a diameter of 18 mm interposition in the gap between the tube and the copper rod of a conductive filling made of copper powder suspended in an organic medium, or copper (50% and and silver (50%) powders suspended in an organic medium, or scales of Wood alloy, alloy 78 (bismuth 50%, lead 25%, tin 15% indium 10%) or equivalents;

evaporation of the medium or melting to the low melting alloy and subsequent cooling and solidification.

The electrical resistance of the electrical contact has then been determined, resulting in a very high value (15–1000 ohm) for all of the samples made of copper or silver-copper powders. Conversely, the resistance of the samples based on low-melting alloys was extremely lower and quite satisfactory (0.002–0.005 Ohm). The same results have been obtained substituting the copper rod with copper wires or copper strands.

Likewise, satisfactory results have been obtained with the electrical contacts based on low melting alloys, which remain liquid even at the operating temperatures of electrolysis when the samples have been used as anodes. Suitable alloys comprise lead (24%), tin (14%), indium (10%), gallium (2%), bismuth (50%).

EXAMPLE 4

Some tubes, provided with the emispheric caps and current feeders have been prepared as described in Example 3 and used as anodes at the following conditions:

| | |
|---|---|
| electrolytic solution | 140–180 g/l fluoroboric acid and 40–80 g/l of lead |
| temperature | ambient |
| anodic current density | 2000 A/m$^2$ |
| cathodic current density (lead cathode) | 1000 A/m$^2$ |

The samples, made of tin dioxide containing 1% copper oxide and 2.5% antimony oxide, as already illustrated in Example 3, had been previously sandblasted on the internal surfaces by corindone. The electrolytic solutions were used as such or added with inhibitors of the anodic formation of lead dioxide. Phosphoric acid, known in the art, and zirconyl phosphate were utilized as inhibitors. The solutions containing 2000 ppm of zirconyl phosphate were further added with compounds capable of acting under homogenous phase as catalysts for tile oxygen evolution reaction. In particular, compounds capable of releasing into tile solutions the ionic couples $Ce^{III}/Ce^{IV}$ and $Pr^{III}/Pr^{IV}$ were selected. The results of the tests expressed as anodic voltages, lead dioxide formation as the parasitic reaction and quality of the plated lead are reported in Table 4. The concentrations of the additives in the solutions are expressed as ppm (parts per million).

TABLE 4

| Additive (ppm) | Anodic voltage Volts Init | (NHE) 300 h | Lead dioxide Formation | Plated lead Quality |
|---|---|---|---|---|
| $H_3PO_4$ | | | | |
| — | 2.7 | 2.6 | high | compact |
| 1000 | 2.7 | 2.8 | moderate | compact |
| 3000 | 2.7 | 2.8 | minimum | compact |
| 6000 | 2.7 | 2.8 | absent | brittle |
| $ZrO(H_2PO_4)_2$ | | | | |
| — | 2.7 | 2.8 | high | compact |
| 500 | 2.7 | 2.8 | moderate | compact |
| 1000 | 2.7 | 2.8 | minimum | compact |
| 3000 | 2.8 | 2.7 | absent | compact |
| $CeO_2$ | | | | |
| — | 2.7 | 2.7 | absent | compact |
| 1000 | 2.7 | 2.7 | absent | compact |
| 5000 | 2.2 | 2.2 | absent | compact |
| 10000 | 2.2 | 2.1 | absent | compact |
| $CeF_3$ | | | | |
| — | 2.7 | 2.8 | absent | compact |
| 1000 | 2.7 | 2.8 | absent | compact |
| 5000 | 2.2 | 2.1 | absent | compact |
| 10000 | 2.2 | 2.1 | absent | compact |
| $CeO_2$ 1000 + $CeF_3$ 1000 | 2.2 | 2.2 | absent | compact |
| $CeO_2$ 5000 + $CeF_3$ 5000 | 2.2 | 2.1 | absent | compact |
| $Pr_6O_{11}$ 5000 | 2.2 | 2.1 | absent | compact |
| $PrF_3$ 5000 | 2.2 | 2.1 | absent | compact |
| $Pr_6O_{11}$ 5000 + $PrF_3$ 5000 | 2.2 | 2.1 | absent | compact |

No appreciable corrosion of the anodes was observed. The data reported on table 4 clearly show that the anodes made of the tubes and caps are compatible with the electrolysis process in solutions containing fluorides and anionic fluorocomplexes as regards the composition, the mechanical stability and the type of electrical contact. The anodic voltages are stable with time and may be further decreased to interesting values for industrial applications by adding to the solutions suitable compounds to catalyze the oxygen evolution reaction. Furthermore, the parasitic reaction of lead dioxide formation, as well as similar parasitic reactions which could take place with different metal ions, is efficiencly prevented by adding to the solutions zirconyl phosphate. This additive, never disclosed in the prior art, requires low concentrations (e.g. 2000 ppm) not to impair the quality of the metal plated to the cathode.

EXAMPLE 5

Tubes provided with caps as described in Example 3, made of tin dioxide added with copper oxide (1%) and antimony oxide (2.5%) were sandblasted with corindone on the internal surface and coated by a a coating based on oxides of cerium, praseodimium, manganese, as such or in combinations thereof, further doped by oxides of the elements of the group of niobium, copper, nickel and chromium.

The coating was directed to catalyze the oxygen evolution reaction avoiding the need to add elements as described in Example 4. The coatings were obtained by applying paints containing precursors salts such as resinates, subsequently thermally decomposed in air at 1250° C., as known in the art, as taught for example in U.S. Pat. No. 3,778,307.

Alternatively, said coatings are obtained by applying paints based on suspensions of preformed powders of the aforementioned oxides, said powders having an average diameter in the range of some microns and the suspensions being stabilized by nitrogen bearing surfactants. The paints were then applied by brush or spray, followed by thermal treatment in air at 1250° C. for three hours. In both cases, the cycle painting-thermal treatment is repeated until a thickness of the coating of about 100 microns is obtained.

The various samples were tested as anodes in the following solutions and at the following conditions:

| electrolytic solution | |
|---|---|
| $HBF_4$ (fluoroboric acid) | 140–180 g/l |
| lead (complex) | 40–80 g/l |
| phosphoric acid (inhibitor of the formation of lead dioxide) | 6 g/l |
| temperature: | ambient |
| anodic current density: | 2000 A/m$^2$ |
| cathodic current density (lead cathode): | 1000 A/m$^2$ |

The samples were then characterized as follows:

| | | |
|---|---|---|
| No. 1 | $CeO_2$ | paint with precursors |
| No. 2 | $CeO_2 + Nb_2O_5(5\%)$ | paint with precursors |
| No. 3 | $CeO_2 + Nb_2O_5(5\%)$ | paint as suspension |
| No. 4 | $CeO_2 + Nb_2O_5(5\%) + NiO(2\%)$ | paint with precursors |
| No. 5 | $CeO_2 + Nb_2O_5(5\%) + NiO(2\%)$ | paint as suspension |
| No. 6 | $CeO_2 + Nb_2O_5(5\%) + CuO(2\%)$ | paint with precursors |
| No. 7 | $CeO_2 + Nb_2O_5(5\%) + CuO(2\%)$ | paint as suspension |
| No. 8 | $CeO_2 + Nb_2O_5(5\%) + NiO(2\%) + CuO(1\%)$ | paint with precursors |
| No. 9 | $Pr_6O_{11}$ | paint with precursors |
| No. 10 | $Pr_6O_{11} + Nb_2O_5(5\%)$ | paint with precursors |
| No. 11 | $Pr_6O_{11} + Nb_2O_5(5\%)$ | paint as suspension |
| No. 12 | $Pr_6O_{11} + Nb_2O_5(5\%) + CuO(2\%)$ | paint with precursors |
| No. 13 | $Pr_6O_{11} + Nb_2O_5(5\%) + CuO(2\%)$ | paint as suspension |
| No. 14 | $CeO_2 + Nb_2O_5(5\%) + CuO(2\%) + + Pr_6O_{11}$ (2%) | paint with precursors |

-continued

| | | |
|---|---|---|
| No. 15 | $CeO_2 + Nb_2O_5(5\%) + CuO(2\%) + + MnO_2$ (2%) | paint with precursors |
| No. 16 | $MnO_2$ | paint with precursors |
| No. 17 | $MnO_2 + CuO(2\%) + Cr_2O_3(2\%)$ | paint with precursors |

The experimental data are collected in Table No. 5.

TABLE 5

| Sample No. | Anodic Voltage Volts initial | (NHE) 300 hours | Behaviour of the Coating |
|---|---|---|---|
| 1 | 2.8 | 2.8 | badly corroded |
| 2 | 2.7 | 2.4 | slightly corroded |
| 3 | 2.7 | 2.4 | slight cracking |
| 4 | 2.2 | 2.2 | not corroded |
| 5 | 2.0 | 2.0 | not corroded |
| 6 | 2.1 | 2.1 | not corroded |
| 7 | 2.1 | 2.1 | not corroded |
| 8 | 2.1 | 2.0 | not corroded |
| 9 | 2.9 | 2.8 | erosion |
| 10 | 2.8 | 2.7 | slight erosion |
| 11 | 2.3 | 2.1 | slight cracking |
| 12 | 2.2 | 2.1 | not corroded |
| 13 | 2.1 | 2.1 | not corroded |
| 14 | 2.2 | 2.3 | not corroded |
| 15 | 2.2 | 2.2 | not corroded |
| 16 | 2.3 | 2.3 | not corroded |
| 17 | 2.3 | 2.3 | not corroded |
| Reference: plain $SnO_2$ + + CuO(1%) + + $Sb_2O_3$(2.5%) | 2.7 | 2.8 | — |

No formation of lead dioxide was experienced. The data reported on Table 5 clearly show that the tubes made of tin dioxide added with copper and antimony oxide may be provided with a coating having a strong resistance to the aggressive attack of the electrocatalytic solutions and concurrently having a remarkable electrocatalytic activity for the oxygen evolution reaction. Similar results have been obtained using these samples in a similar solution as the one used to obtain the data reported in Table 5, the only difference being the addition of fluorosilic acid (120–140 g/l) instead of fluoroboric acid.

EXAMPLE 6

Five anodes prepared as sample no. 6 of Example 5 were further coated with a zirconyl phosphate layer, obtaining a thickness varying from 10 to 250 microns, by plasma spray technique. The samples were used as anodes at the same conditions as illustrated in the previous examples, the only difference being that no inhibitors were added to avoid formation of lead dioxide. The tests showed that with layers of zirconyl phosphate above 50 micron, no lead dioxide formation is experienced. However said thickness must be maintained below 250 micron to avoid increasing the anodic voltage.

We claim:

1. A process for the electrolytic recovery of metals from solutions containing metal ions and fluorides or anionic fluorocomplexes carried out in diaphragmless cells, said process comprising the steps of metal deposition from said metal ions and oxygen evolution characterized in that the said oxygen evolution takes place at ceramic insoluble anodes which resist the aggressive action of said solutions, said anodes being made of sinterized powders of tin dioxide doped with copper oxide and antimony oxide or copper oxide and chromium oxide or copper oxide and praseodymium oxide.

2. The process of claim 1 wherein the ratio by weight of said copper oxide and antimony oxide is 1% and 1 to 3% respectively.

3. The process of claim 1 wherein said metal ions are selected from the group consisting of lead, tin and chromium ions.

4. The process of claim 1 wherein the said solutions further contain zirconyl phosphate to prevent the deposition of high-valence oxides of said metal ions onto the anode surface.

5. The process of claim 4 wherein the concentration of zirconyl phosphate in said solutions is between 500 and 3,000 parts per million.

6. The process of claim 1 wherein said solutions further contain ionic couples selected from the group consisting of $Ce^{III}/Ce^{IV}$ and $Pr^{III}/Pr^{IV}$ to catalyze the oxygen evolution reaction.

7. The process of claim 1 wherein said anodes comprise a layer of zirconyl phosphate.

8. The process of claim 7 wherein the thickness of said layer of zirconyl phosphate is 10 to 250 microns.

9. The process of claim 1 wherein said anodes further comprise a coating to catalyze the oxygen evolution reaction, said coating being based on oxides of metals selected from the group consisting of cerium, praseodymium, manganese and combinations thereof, further doped by oxides of the elements selected from the group consisting of niobium, copper, nickel and chromium.

* * * * *